US008350770B1

(12) United States Patent
Dawson

(10) Patent No.: US 8,350,770 B1
(45) Date of Patent: Jan. 8, 2013

(54) CONFIGURABLE GROUND PLANE SURFACES FOR SELECTIVE DIRECTIVITY AND ANTENNA RADIATION PATTERN

(75) Inventor: David C. Dawson, Lemon Grove, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 378 days.

(21) Appl. No.: 12/830,662

(22) Filed: Jul. 6, 2010

(51) Int. Cl.
*H01Q 1/50* (2006.01)

(52) U.S. Cl. ..... 343/761; 343/700 MS; 343/861; 343/789; 343/795

(58) Field of Classification Search ..... 343/761, 343/700 MS, 702, 783, 789, 793, 795, 772, 343/861, 872
See application file for complete search history.

(56) References Cited

U.S. PATENT DOCUMENTS

| | | | | |
|---|---|---|---|---|
| 6,039,583 | A | 3/2000 | Lorsunsky | |
| 6,100,855 | A | 8/2000 | Vinson | |
| 6,292,143 | B1 | 9/2001 | Romanofsky | |
| 6,343,208 | B1 | 1/2002 | Ying | |
| 6,480,170 | B1 | 11/2002 | Langley | |
| 6,501,427 | B1 | 12/2002 | Lilly | |
| 6,618,016 | B1 | 9/2003 | Hannan | |
| 6,739,884 | B2 | 5/2004 | Vicich | |
| 6,756,552 | B2 | 6/2004 | Takenaka | |
| 6,819,291 | B1 | 11/2004 | Lackey | |
| 6,906,680 | B2 | 6/2005 | Rawnick | |
| 6,967,628 | B2 | 11/2005 | Rawnick | |
| 7,084,828 | B2 | 8/2006 | Rawnick | |
| 7,336,238 | B2 | 2/2008 | Rawnick | |
| 7,397,431 | B2 | 7/2008 | Baliarda | |
| 7,583,236 | B1 | 9/2009 | Lopez | |
| 2004/0252069 | A1 * | 12/2004 | Rawnick et al. | 343/789 |
| 2005/0048934 | A1 * | 3/2005 | Rawnick et al. | 455/107 |
| 2005/0057415 | A1 * | 3/2005 | Rawnick et al. | 343/795 |
| 2006/0256027 | A1 * | 11/2006 | Rawnick et al. | 343/861 |
| 2007/0080891 | A1 | 4/2007 | De Lustrac | |

OTHER PUBLICATIONS

M. Mukhopadhyay, B. K. Sarkar, and A. Chakraborty, "Augmentation of Anti-jam GPS System Using Smart Antenna with a Simple DOA Estimation Algorithm," Progress in Electromagnetics Research, PIER 67, 231-249, 2007. doi:10.2528/PIER06090504.

Bauregger, Frank N., Walter, Todd, Akos, Dennis, Enge, Per, "A Novel Dual Patch Anti Jam GPS Antenna," Proceedings of the ION Institute of Navigation 58th Annual Meeting and CIGTF 21st Guidance Test Symposium, Albuquerque, NM, Jun. 2002, pp. 516-522.

* cited by examiner

*Primary Examiner* — Vibol Tan
(74) *Attorney, Agent, or Firm* — Kyle Eppele; Stephen E. Baldwin

(57) ABSTRACT

In one embodiment, the present invention provides a configurable ground plane for a matched antenna so that by configuring or changing the ground plane shape in a controlled manner, a change in the radiation pattern can be achieved such that the main beam of the antenna is steered in a particular direction, and a null in another direction. According to one aspect of the present invention, antennas such as monopole or patch antennas with a configurable ground plane of the present invention with a plurality of configurable sectors can be made to change in shape, size and conductivity. Such ground plane modifications can be used to select the direction of maximum gain away from a direction of interference, such in the case of tactical jamming. Likewise, the ground plane modifications can be used to steer the maximum directivity of an antenna in a desired direction for increased signal integrity.

13 Claims, 11 Drawing Sheets

CONFIGURABLE GROUND PLANE SURFACES FOR SELECTIVE DIRECTIVITY AND ANTENNA RADIATION PATTERN

FEDERALLY-SPONSORED RESEARCH AND DEVELOPMENT

This invention (Navy Case No. 100,272) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND

The present invention relates to ground planes utilized with antennas such as patch or monopole antennas, and in particular with what are called anti jam antennas. In the case of anti jam antennas, one current approach is done with phased arrays of antennas. Digital signal processing is used to set weights or phase shifts to different antenna radiators such that the beams are steered a desired direction. However, the phased array approach requires multiple radiators.

Other approaches use a liquid conductor to change the input impedance of the antenna, so that it is well matched and no power is wasted. Another way configures the radiator or the ground plane, but for the same reason—the impedance is well matched and no power is wasted.

SUMMARY

In one embodiment, the present invention provides a configurable ground plane for a matched antenna so that by configuring or changing the ground plane shape in a controlled manner, a change in the radiation pattern can be achieved such that the main beam of the antenna is steered in a particular direction, and a null in another direction. According to one aspect of the present invention, antennas such as monopole or patch antennas with a configurable ground plane with a plurality of configurable sectors that can be made to change in shape, size and conductivity. Such ground plane modifications can be used to select the direction of maximum gain away from a direction of interference, such in the case of tactical jamming. Likewise, the ground plane modifications can be used to steer the maximum directivity of an antenna in a desired direction for increased signal integrity.

BRIEF DESCRIPTION OF THE DRAWINGS

Throughout the several views, like elements are referenced using like references, wherein.

DETAILED DESCRIPTION OF THE EMBODIMENTS

An object of this invention is to provide antennas such as monopole or patch antennas with a ground plane that can be made to change in shape, size and conductivity. Such ground plane modifications can be used to select the direction of maximum gain away from the direction of interference, such in the case of tactical jamming. Likewise, it can be used to steer the maximum directivity of an antenna in a desired direction for increased signal integrity.

Figure 1:
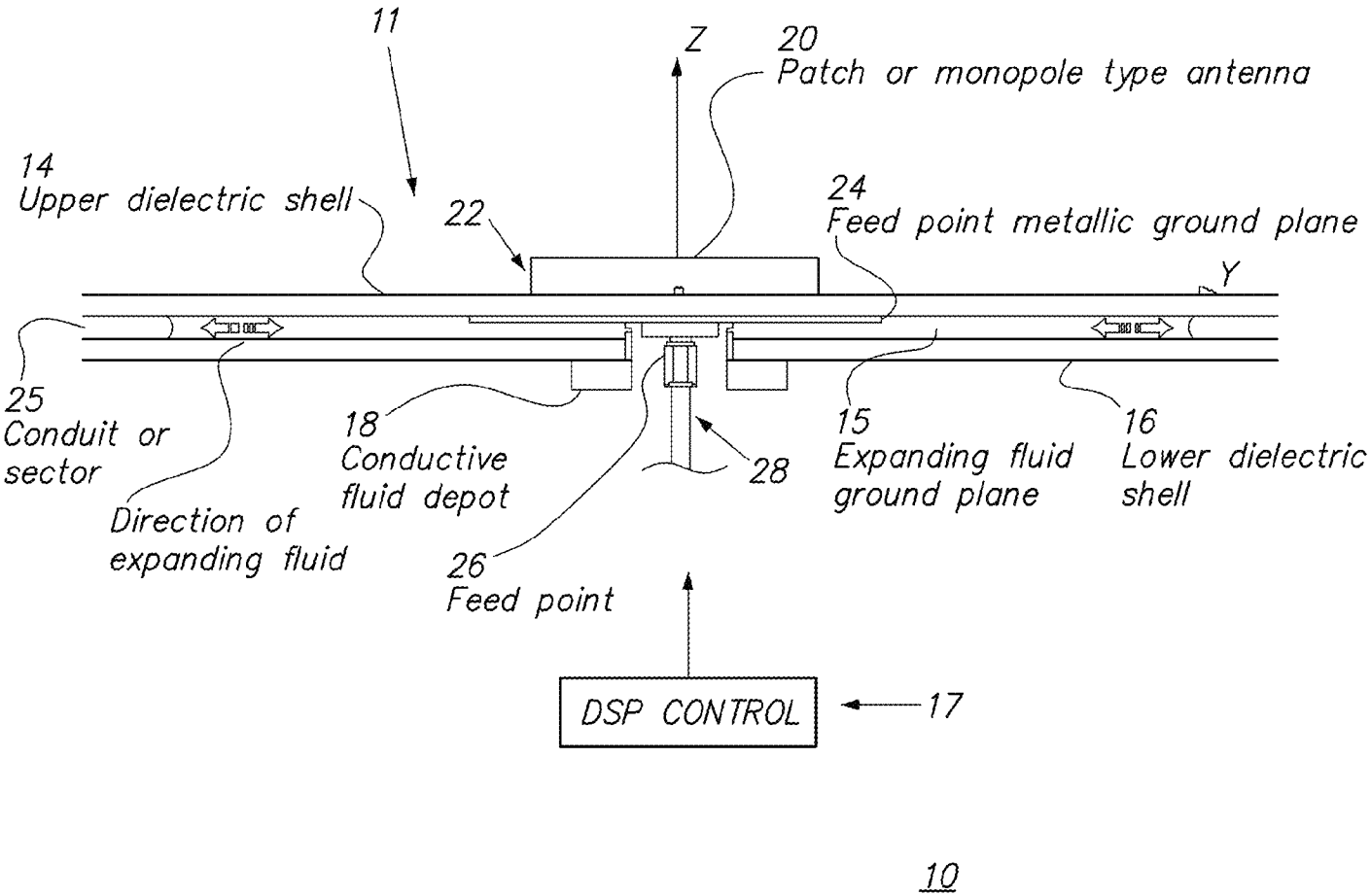
FIG. 1 shows a cross-sectional view of a configurable ground plane of the present invention with a patch antenna on top.

As seen in FIG. 1, one embodiment of the apparatus 10 which forms the present invention includes a configurable ground plane 11, which is composed two layers of a thin, low loss dielectric material, shown in FIG. 1 as upper and lower dielectric shells 14, 16. An electrically conductive fluid, such as a liquid alloy or simply sea water, can be made to flow along the conduit cavity 15 formed between the two layers by using thermal, pressure or electro-chemical processes. The conductive fluid is held by the fluid's own surface tension. The conductive fluid is stored in a conductive fluid reservoir 18, which is typically below the lower shell 16. A feed point metallic ground plane 24 enables the configurable ground plane 11 to connect to the transmission line (coaxially cable 28) and the transferred conductive fluid.

The size of the feed point metallic ground plane 24 is large enough to prevent large input impedance transformations when the ground plane configuration is changed. As the conductive fluid is transferred or expands, the ground plane 11 is shaped, expanded and configured in the direction of predesigned conduits or sectors 25. As indicated above, the conductive fluid can be transferred in a controlled manner by thermal, pressure or electro-chemical processes.

In one embodiment, depriving a selected sector 25 of the conductive fluid prevents electric current in that sector and therefore reduces the directivity and gain in that direction. Multiple sectors 25 can be designed between the dielectric shells 14, 16 for added variation of possible configurations and versatility. DSP (digital signal processing) algorithms can be developed to fill up specific sectors (or a portion of specific sectors), enabling the antenna to produce a large variety of radiation patterns for different scenarios.

Continuing with the drawings, FIG. 1 shows a cross-sectional view of a configurable ground plane device 10 of the present invention. The device 10 in FIG. 1 includes a configurable ground plane 11 coupled electrically with an antenna element 20 (shown in better view in FIGS. 2 and 3), which is disposed on top of a dielectric substrate 22. The antenna element 20 could typically be a monopole antenna or a patch antenna. The connector 26 for coaxially cable 28 is typically a SMA (SubMinature version A) connector (with male/female components).

The ground plane 11 in FIG. 1 is comprised of an upper dielectric shell 14 and a lower dielectric shell 16. The pair of shells 14, 16 are configured to form a plurality of sectors (as seen more clearly in FIGS. 2 and 3), with each sector forming a conduit cavity 15.

As described above, the fluid reservoir 10 contains a suitable conductive fluid, such as a liquid alloy (e.g., liquid mercury) or seawater. The conductive fluid can be controllably transferred to any one or more of the sectors 25, each of which have a conduit cavity 15, as formed by the dielectric shell pairs 14, 16. A suitable control means is DSP Control 17, as shown in FIG. 1.

Figure 2:
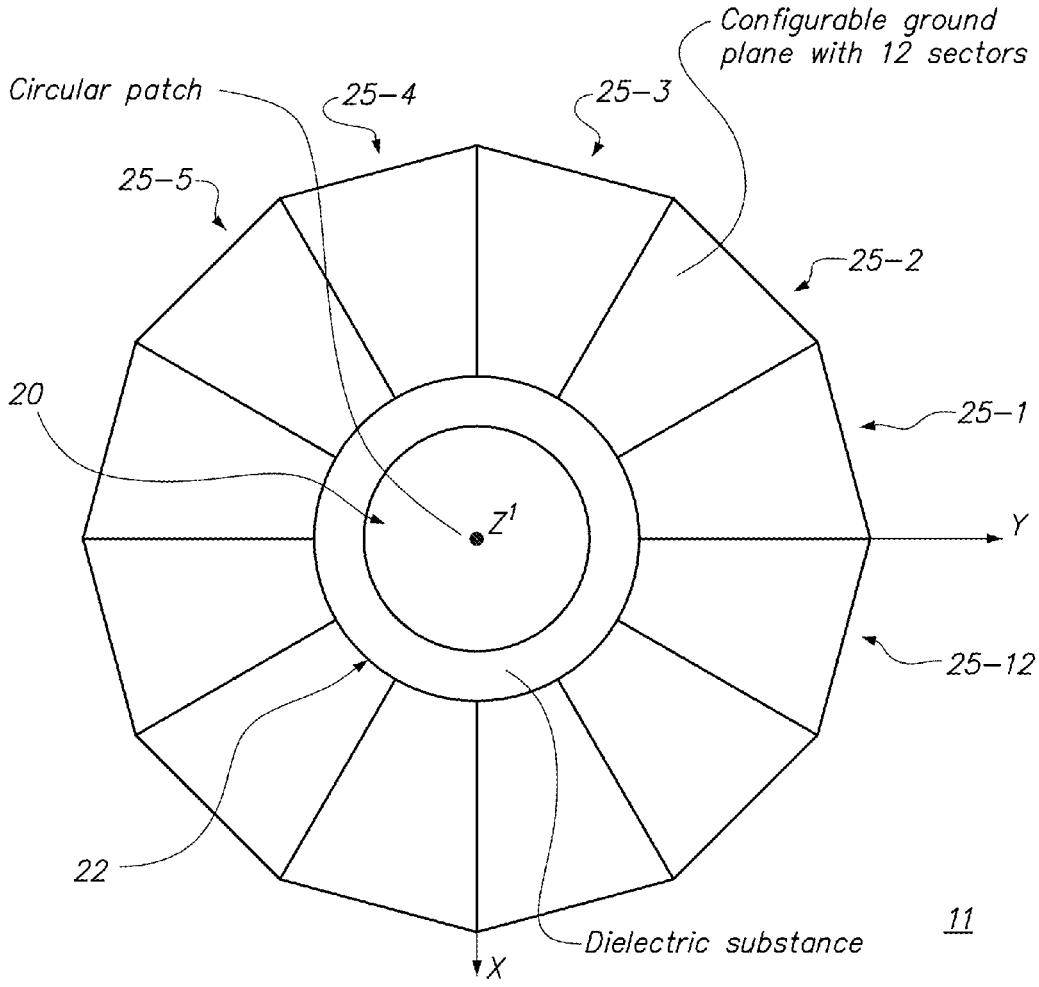
FIG. 2 shows a top view of a configurable ground plane of FIG. 1 with 12 sectors.

In FIG. 2, the circular patch antenna element 20 is shown more clearly above dielectric substrate 22. The ground plane 11 in one embodiment includes multiple sectors 25. As an example, ground plane 11 in FIG. 2 shows a total of twelve sectors, identified as sectors 25-1, 25-2, . . . , 25-12. Other sector configurations are of course possible. For clarity purposes, sectors 25-1 through 25-12 in FIG. 2 are shown as not configured initially, which should be compared with the re-configuration shown in FIG. 3.

Figure 3:
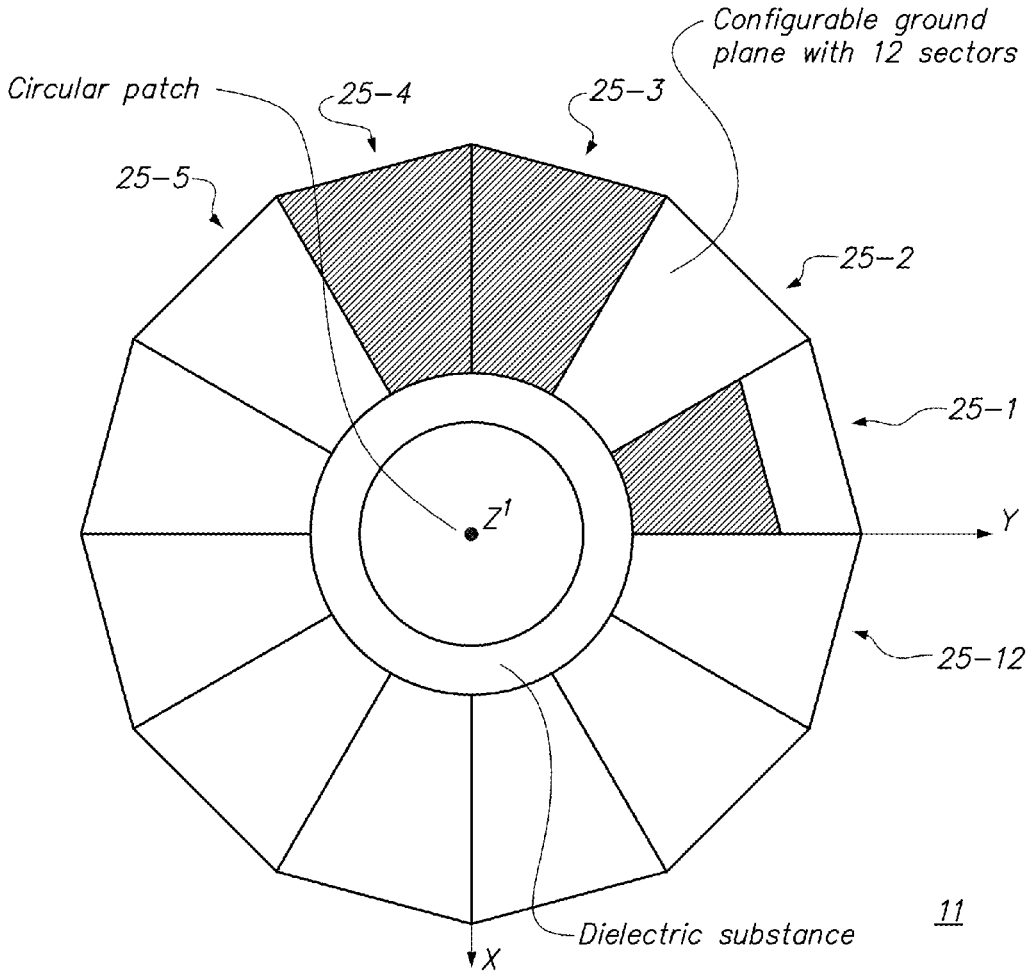
FIG. 3 shows a top view of the configurable ground plane of FIG. 2 with several of the sectors reconfigured according to the present invention.

FIG. 3 shows a top view of the configurable ground plane of FIG. 2 with several of the sectors 25 re-configured according to the present invention. As an example, sectors 25-3 and 25-4 have been completely configured with a conductive fluid within their respective conduit cavities, while sector 25-1 has been partially configured with a conductive fluid. Sectors 25-2 and 25-5 through 25-12 are shown as not re-configured at all. This process of configuration could be achieved with suitable DSP algorithms, as discussed above. A control mechanism such as DSP Control 17 shown in FIG. 1 could configure the sectors 25 according to suitable DSP algorithms.

In FIG. 3, sectors 25-2 and 25-5 through 25-12 have not been re-configured at all, while sectors 25-3 and 25-4 have been completely re-configured, and sector 25-1 has been partially re-configured. As is apparent, the controlled and changeable configurability of selected sectors or portion of sectors of the ground plane as shown in FIG. 2 is an important aspect of the present invention.

Figure 4:
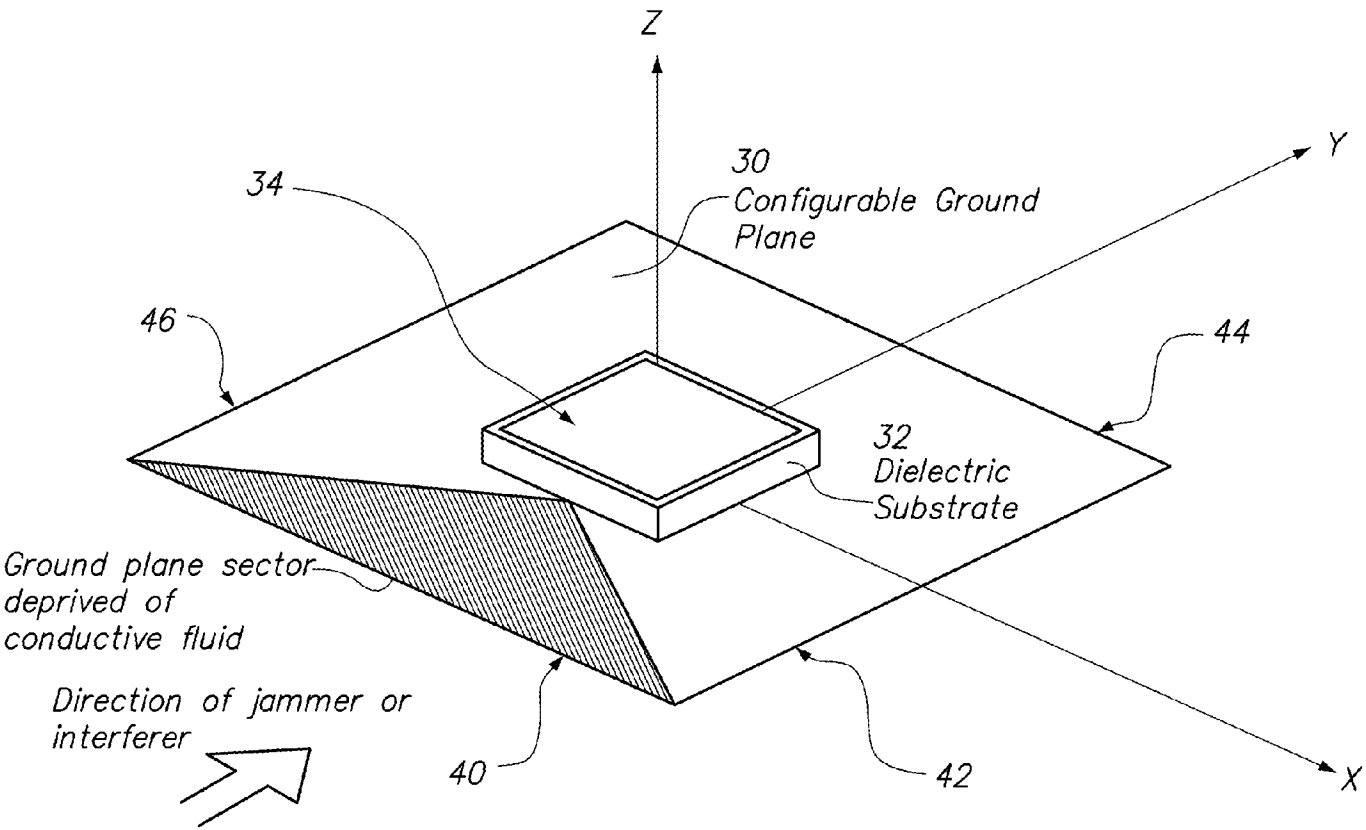
FIG. 4 shows a simulation performed with a configurable ground plane of the present invention used with a simple square patch type antenna.

FIG. 4 shows a simulation performed with a configurable ground plane of the present invention used with a simple square patch type antenna. In FIG. 4, an antenna element 34 is above dielectric substrate 32, which is in turn above the configurable ground plane 30. The ground plane 30 includes four separate sectors 40, 42, 44, 46. Sector 40 is shown in the direction of a jamming or interfering signal. Sector 40 is also shown as deprived of conductive fluid for decreased gain/directivity (e.g., a null), while sectors 42, 44, 46 are seen as completely contained with a conductive fluid for increased gain/directivity, all of which can be selectively controlled by the aspects of the present invention, such as a DSP Control 17 as shown in FIG. 1.

Figure 5:
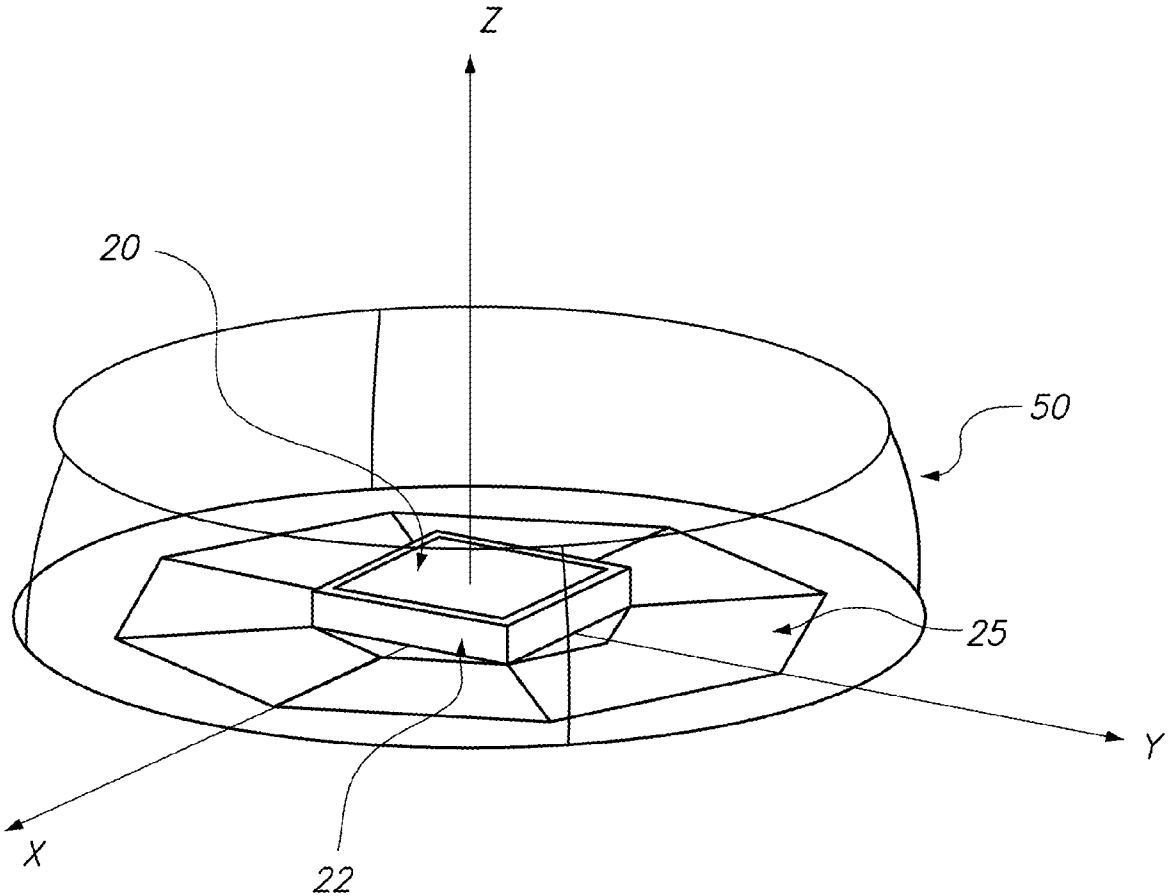
FIG. 5 shows a standard circular polarization patch antenna with a round configurable ground plane of the present invention.
Figure 6:
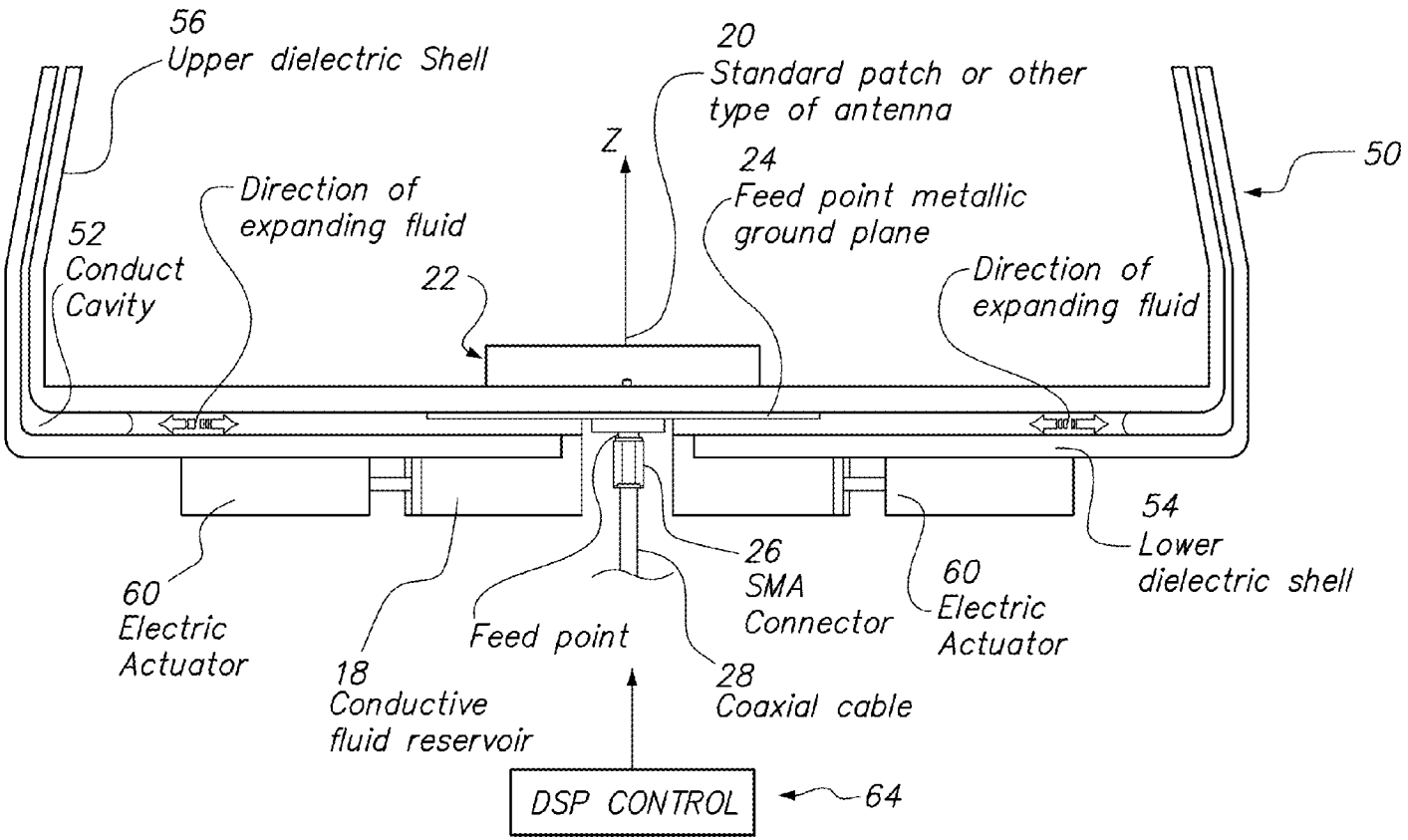
FIG. 6 shows a detailed side view of the configurable ground plane shown in FIG. 5.

FIG. 5 shows a standard circular polarization patch antenna with a round configurable ground plane of the present invention and FIG. 6 shows a detailed side view of the configurable ground plane shown in FIG. 5.

The components of the device shown in FIG. 6 are similar to those shown in FIG. 1, with the addition of curved wall portion 50, formed by curved or bent dielectric shells 56, 54 which are formed at the edges of the ground plane. An electric actuator 60 is shown in FIG. 6 to provide for controlled transfer of the conductive fluid from reservoir 18 to a selected sector. The actuator is controlled by DSP Control 64, using algorithms described above. The curved walls 50 in FIG. 6 are also seen in the perspective view shown in FIG. 5.

Figure 7:
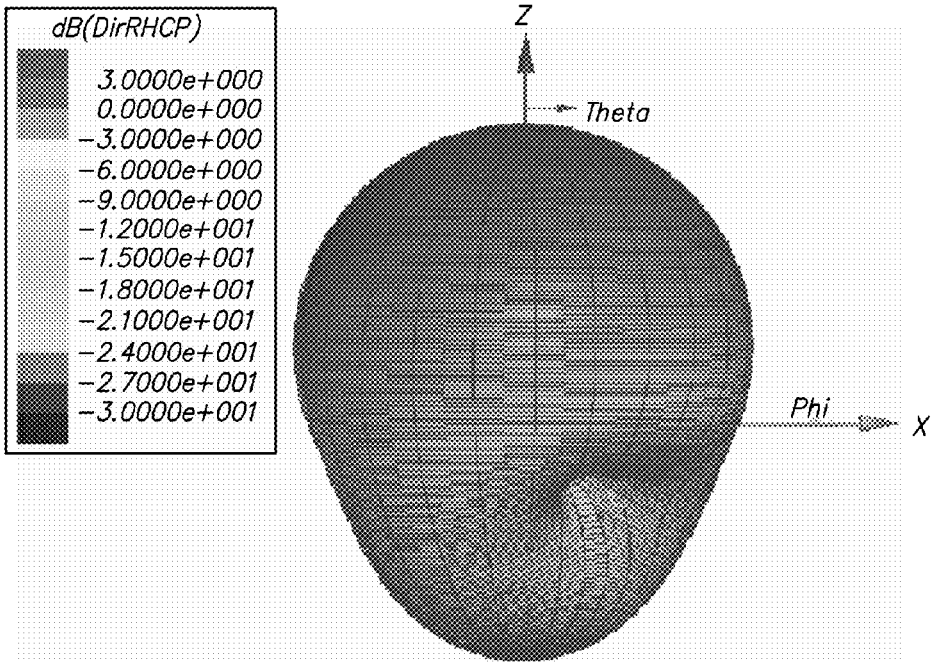
FIG. 7 shows the gain of a standard circular polarization patch with no configurable ground plane.

FIG. 7 shows the gain of a standard circular polarization patch with no configurable ground plane. The DirRHCP Table (direction of right hand circular polarization in dB) in the left hand portion of FIG. 7 shows the range of increasing to decreasing gain or directivity patterns, with a range of changing patterns shown between approximately +3 dB and −3 dB.

Figure 8:
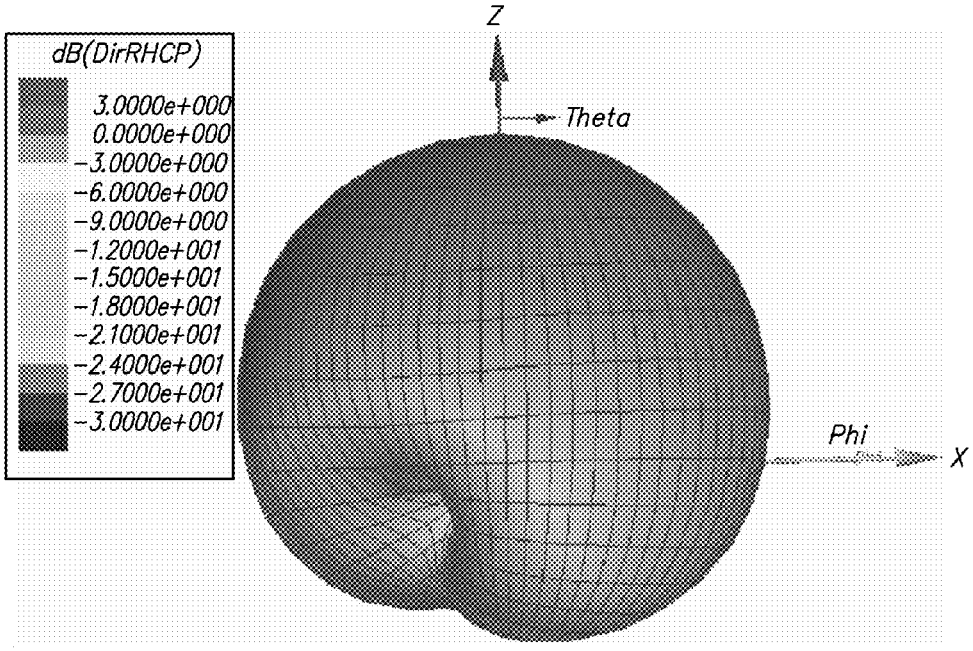
FIG. 8 shows the gain of a circular polarization patch antenna with a configurable ground plane of the present invention.

In contrast, FIG. 8 shows the gain of a circular polarization patch antenna with a configurable ground plane of the present invention. The nulls in FIG. 8 point towards the horizon, and less gain is shown projected downward, and a range of changing patterns shown approximately between +3 dB and −3 dB.

Figure 9:
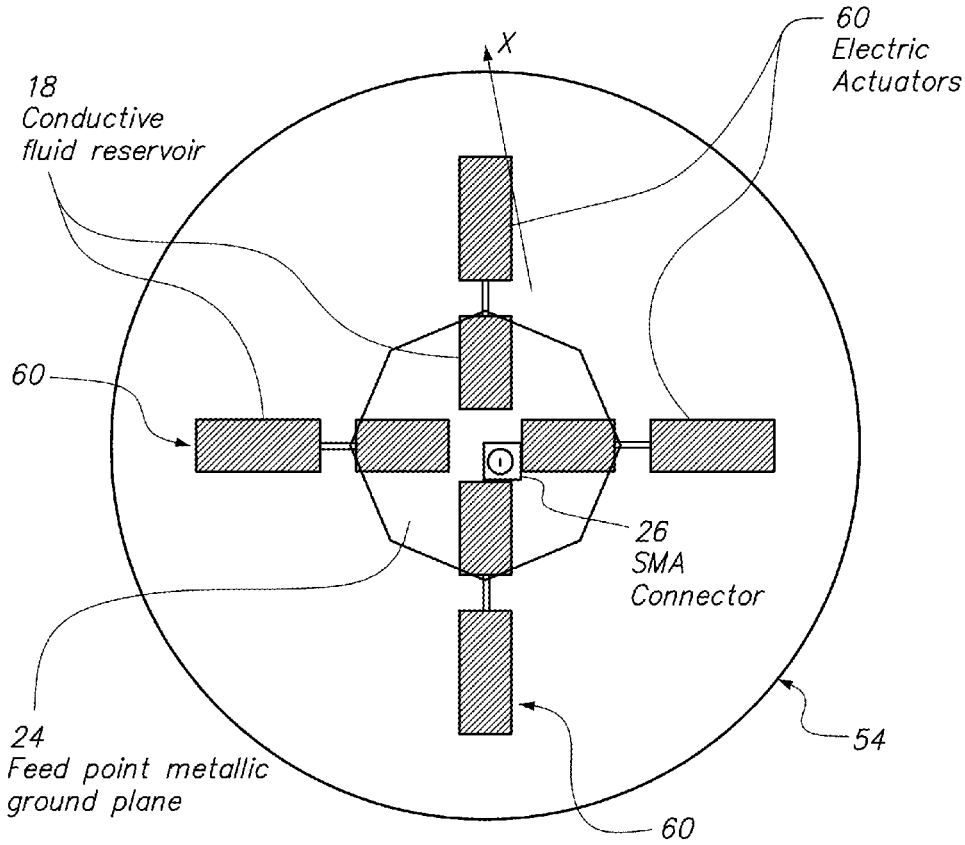
FIG. 9 shows a bottom view of the configurable ground plane of the present invention.

FIG. 9 shows a bottom view of the configurable ground plane of the present invention. In FIG. 9, the electric actuators 60 are shown configured with a respective conductive fluid reservoir 18, below the feed point metallic ground plane 24.

Figure 10:
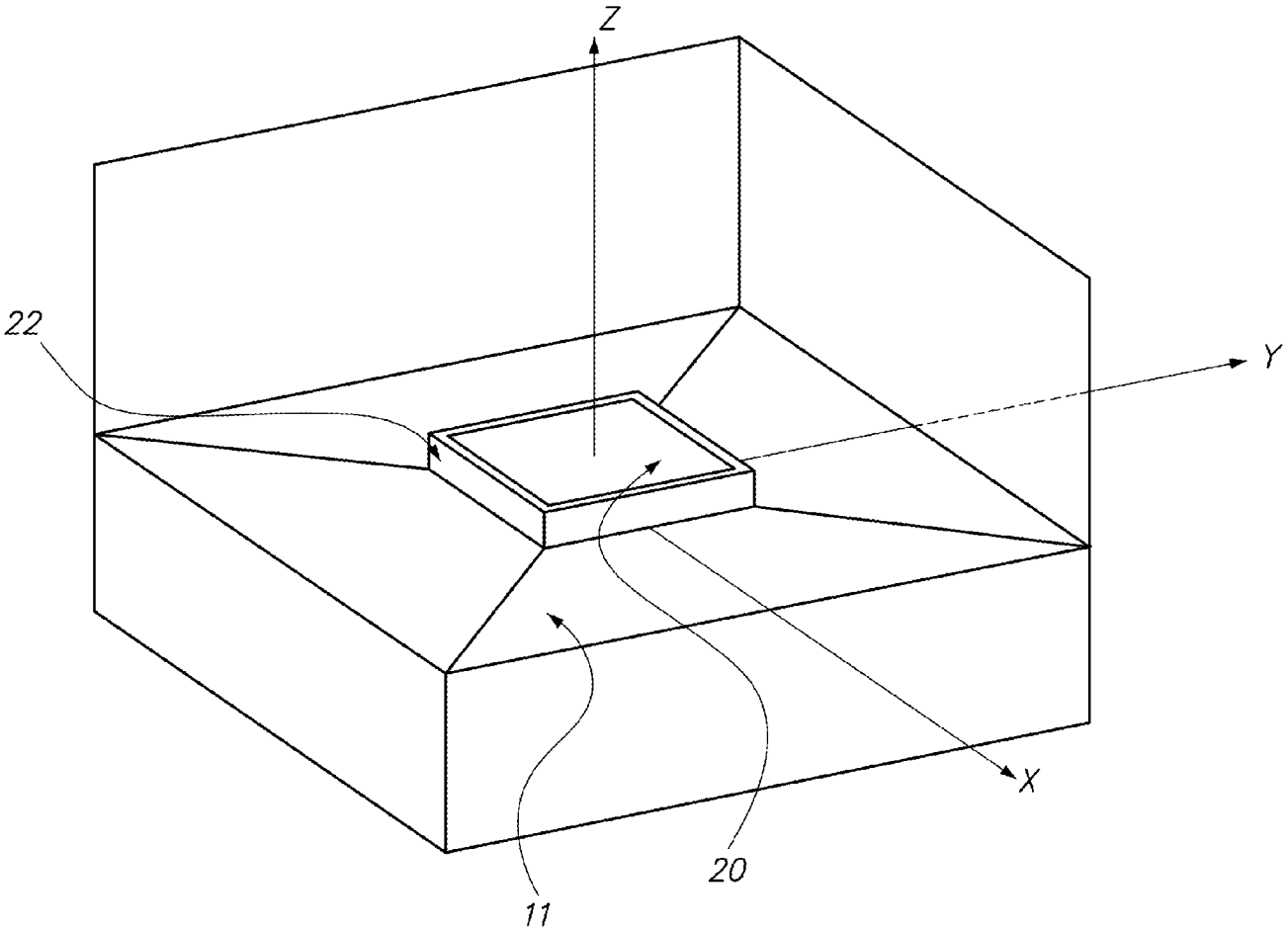
FIG. 10 shows a standard circular patch antenna with a square configurable ground plane of the present invention.
Figure 11:
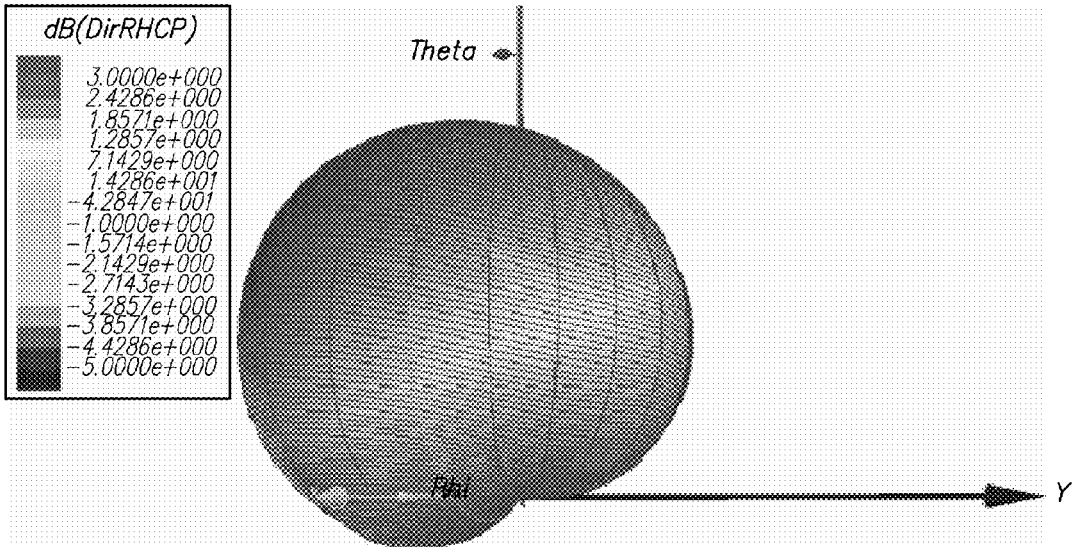
FIG. 11 shows the gain of a circular polarization patch antenna with a square ground plane of the present invention.

FIG. 10 shows a patch antenna 20 and dielectric substrate 22 with a square configurable ground plane 11 of the present invention. FIG. 11 shows the gain of a circular polarization patch antenna with a square ground plane of the present invention, and a range of changing patterns shown approximately between +3 dB and −5 dB. In FIG. 11, the main beam is turned away from the non-desired direction, in accordance with the present invention.

Figure 12:
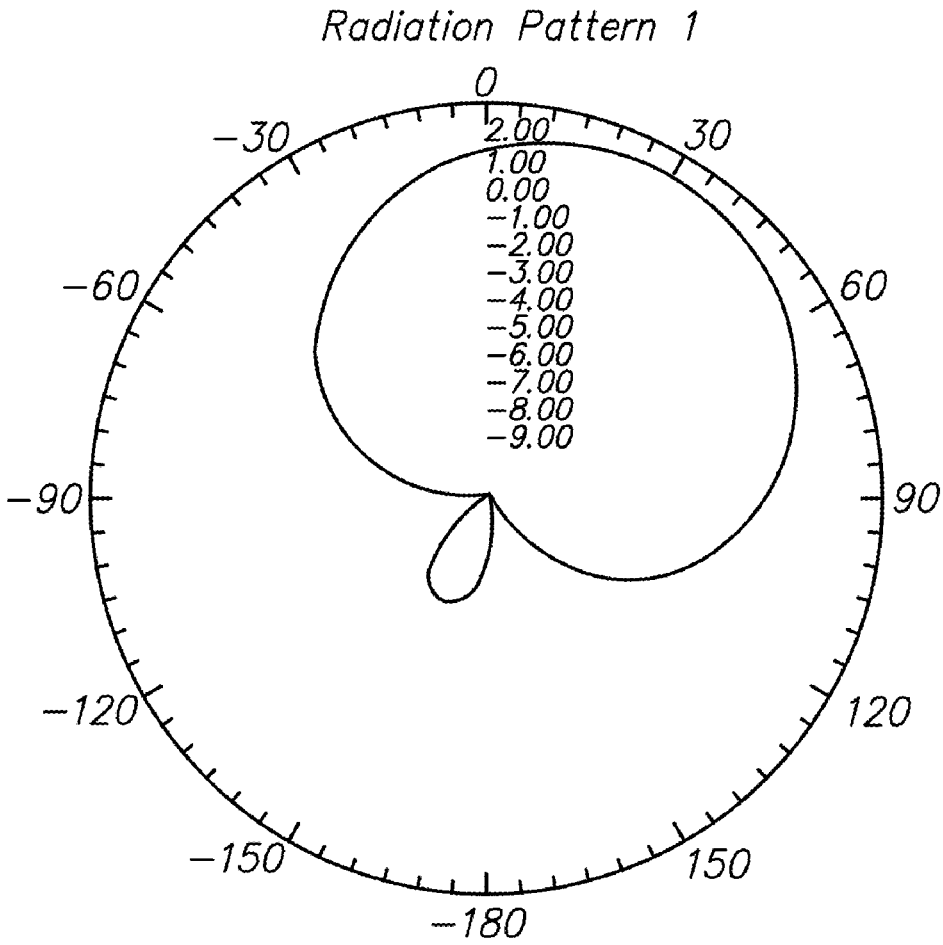
FIG. 12 shows the gain of a circular polarization patch antenna with a square configurable ground plane of the present invention.

FIG. 12 shows the gain of a circular polarization patch antenna with a square configurable ground plane of the present invention. In FIG. 12, the main beam is radiated away from the non-desired direction, again in accordance with the present invention.

One advantage of the antenna of the present invention over phased arrays is that phased arrays require multiple radiators. The present invention is able to steer nulls by simply choosing a sector of the ground plane and block the flow of conductive fluid through that selected sector, as has been shown and described above. The more sectors selected, the more nulls that can be created. This can be done regardless of the type of antenna that is placed over the ground plane, and a large number of radiation patterns can be produced. The different configurations that produce these different radiation patterns can be stored in memory and DSP algorithms can be developed to produce the best radiation pattern capable of the antenna for the specific situation.

From the above description, it is apparent that various techniques may be used for implementing the concepts of the present invention without departing from its scope. The described embodiments are to be considered in all respects as illustrative and not restrictive. It should also be understood that system is not limited to the particular embodiments described herein, but is capable of many embodiments without departing from the scope of the claims.

What is claimed is:

1. An apparatus comprising:

an antenna element for transmitting/receiving a range of electromagnetic waves having radiation patterns with fixed gain and directivity parameters;

a configurable ground plane couple with the antenna element, the configurable ground plane including a pair of dielectric layers forming a plurality of separate sectors between the pair of layers where each sector has a conduit cavity;

a fluid reservoir for storing an electrically conductive fluid;

means for controllably transferring the electrically conductive fluid between the fluid reservoir and selected sectors via their respective conduit cavities to reshape the radiation pattern of the antenna element with changed gain or directivity values corresponding to the range of transmitted or received electromagnetic wave patterns, and means for steering of a radiation pattern to a first direction corresponding to a selected sector for increased gain.

2. An apparatus comprising:

an antenna element for transmitting/receiving a range of electromagnetic waves having radiation patterns with fixed gain and directivity parameters;

a configurable ground plane coupled with the antenna element, the configurable ground plane including a pair of dielectric layers forming a plurality of separate sectors between the pair of layers where each sector has a respective conduit cavity;

a fluid reservoir for storing an electrically conductive fluid;

means for controllably transferring the electrically conductive fluid between the fluid reservoir and selected ones of the conduit cavities corresponding to the respective fluid sectors to form one or more selected sectors with changed gain or directivity patterns corresponding to the range of transmitted or received electromagnetic wave patterns, and means for steering of a radiation pattern to a first direction corresponding to a selected sector for increased gain.

3. The apparatus of claim 2 wherein the antenna element is a patch antenna.

4. The apparatus of claim 2 wherein the antenna element is a monopole antenna.

5. The apparatus of claim 2 wherein the selected sectors have a controlled change in shape, size, or conductivity.

6. The apparatus of claim 5 including means for forming a null of a radiation pattern in a second direction corresponding to a non-selected sector.

7. The apparatus of claim 2 wherein the pair of dielectric layers include a thin and flat low loss dielectric.

8. The apparatus of claim 2 wherein the selected sectors are partially filled sectors.

9. The apparatus of claim 2 wherein the selected sectors are completely filled sectors.

10. The apparatus of claim 2 including at least one actuator for transferring the conductive fluid.

11. The apparatus of claim 2 wherein the edge of the ground plane forms a curved wall portion.

12. A configurable ground plane coupled with an antenna element for transmitting/receiving a range of electromagnetic waves having radiation patterns with fixed gain and directivity parameters, the configurable ground plane comprising:

a first layer of a dielectric material;

a second layer of the dielectric material arranged with the first layer such that a conduit is formed between the two layers where the two layers form predetermined, separate sectors where each sector has a respective conduit cavity;

a fluid reservoir for storing an electrically conductive fluid; and

DSP control means for controllably transferring the electrically conductive fluid into selected ones of the conduit cavities of the sectors to enable selection of maximum gain in a first selected direction of a radiation pattern and a null in another second selected direction with the antenna element.

13. An antenna comprising an antenna radiating element for transmitting/receiving a range of electromagnetic waves having radiation patterns with fixed gain and directivity parameters;

a configurable ground plane coupled with the antenna radiating element, the configurable ground plane including a pair of dielectric layers forming a plurality of separate sectors between the pair of layers where each sector has a respective conduit cavity and where an electrically conductive fluid is controllably transferred into selected ones of the sectors;

a dielectric substrate disposed between the antenna element and the ground plane; a feed point;

a feed point metallic ground plane to prevent large input impedance transformations when the configuration of the configurable ground plane is changed;

a feed point connected to a transmission line and the feed point metallic ground plane to enable the configurable ground plane to connect to the transmission line; and DSP control means for controllably transferring the electrically conductive fluid to the selected sectors via their respective conduit cavities to reshape the radiation pattern of the antenna element with changed gain or directivity values corresponding to the range of transmitted or received electromagnetic wave patterns.

* * * * *